US010527331B2

(12) United States Patent
Mullis et al.

(10) Patent No.: US 10,527,331 B2
(45) Date of Patent: Jan. 7, 2020

(54) COMPACT INDIVIDUAL MULTISTAGE UNIVERSAL HYBRID OIL SEPARATOR

(71) Applicant: Hill Phoenix, Inc., Conyers, GA (US)

(72) Inventors: John Vincent Mullis, Newnan, GA (US); Senthilkumar Kandappa Goundar Shanmugam, Covington, GA (US)

(73) Assignee: Hill Phoenix, Inc., Conyers, GA (US)

( * ) Notice: Subject to any disclaimer, the term of this patent is extended or adjusted under 35 U.S.C. 154(b) by 204 days.

(21) Appl. No.: 15/723,547

(22) Filed: Oct. 3, 2017

(65) Prior Publication Data

US 2019/0101312 A1 Apr. 4, 2019

(51) Int. Cl.
*F25B 43/02* (2006.01)
*F25B 43/00* (2006.01)

(52) U.S. Cl.
CPC ..... *F25B 43/02* (2013.01); *F25B 43/003* (2013.01); *F25B 2400/23* (2013.01)

(58) Field of Classification Search
CPC .... F25B 43/02; F25B 31/004; F25B 2400/23; F25B 2341/0016; B60H 1/3214
See application file for complete search history.

(56) References Cited

U.S. PATENT DOCUMENTS 441,995 A * 12/1890 Wheeler ..... F25B 31/004 62/193
2,716,509 A * 8/1955 Saul ..... B23Q 11/1084 222/173
3,923,480 A * 12/1975 Visch ..... F04B 39/16 96/360
4,516,994 A 5/1985 Kocher
4,690,759 A * 9/1987 Mandy ..... B01D 45/14 210/304
4,788,825 A * 12/1988 Calupca ..... B01D 46/12 55/321
4,848,989 A * 7/1989 Maeda ..... B01D 46/0012 55/319
5,039,323 A 8/1991 Ulitsky et al.
5,214,937 A * 6/1993 Henrichs ..... B01D 50/002 181/403
6,244,059 B1 * 6/2001 Hill ..... F25B 31/004 62/193
6,709,476 B2 * 3/2004 Kitano ..... B01D 45/12 55/396
6,858,067 B2 * 2/2005 Burns ..... B01D 45/16 415/169.2

(Continued)

*Primary Examiner* — Cassey D Bauer
(74) *Attorney, Agent, or Firm* — Foley & Lardner LLP

(57) ABSTRACT

Various embodiments disclosed herein related to a multi-stage oil separator. The oil separator includes a housing having a nozzle and defining an internal space and an oil outlet; a body disposed within the internal space, the body including a mixed fluid inlet configured to receive a coolant and oil mixture and a nozzle that receives at least a portion of the coolant and oil mixture from the mixed fluid inlet and discharges coolant and oil into the internal space of the housing; and, a wall disposed proximate to the nozzle of the body, wherein at least a portion of the discharged coolant and oil impacts the wall to direct the at least the portion of coolant and oil towards the nozzle of the housing. The oil separator functions to separate the coolant from the oil discharged from a compressor in a cooling system.

18 Claims, 10 Drawing Sheets

(56) References Cited

U.S. PATENT DOCUMENTS

| | | | | |
|---|---|---|---|---|
| 7,810,351 | B2 * | 10/2010 | Westermeyer | F25B 43/02 62/470 |
| 8,147,575 | B2 * | 4/2012 | Lucas | B01D 45/12 55/337 |
| 2008/0034784 | A1 * | 2/2008 | Schillemeit | F04B 27/109 62/470 |

* cited by examiner

COMPACT INDIVIDUAL MULTISTAGE UNIVERSAL HYBRID OIL SEPARATOR

TECHNICAL FIELD

The present disclosure relates to a cooling system. More specifically, the present disclosure relates to an oil separator used in the cooling system for a temperature controlled space/environment, such as a temperature controlled case or a temperature controlled room.

BACKGROUND

Temperature controlled cases are used for the storage, preservation, and presentation of products, such as food products including perishable meat, dairy, seafood, produce, etc. To facilitate the preservation of the products, temperature controlled cases often include one or more cooling systems for maintaining a display area of the case at a desired temperature. The one or more cooling systems may include one or more cooling elements (e.g., cooling coils, heat exchangers, evaporators, fan-coil units, etc.) through which a coolant or refrigerant is circulated (e.g., a liquid such as a glycol-water mixture, etc.) to provide cooling to an internal cavity of the case. As a result of the cooling, the food products or other stored items are typically maintained in a chilled state.

Lubricants, such as oil, are typically utilized with one or more components of the cooling system. Particularly, a compressor is utilized to pump or circulate the coolant throughout the cooling system. The compressor includes various moving components, such as one or more pistons, that utilize oil for lubrication. However, oil is miscible in the coolant. This miscibility may result in coolant seeping into the compression cylinders of the compressor and at least some oil being circulated throughout the cooling system. Detrimentally, the presence of oil in various locations of the cooling system will inhibit the coolant's heat transfer ability, which may impact performance of the cooling system (e.g., oil may coat the evaporator coils thereby inhibiting heat transfer with the coolant that is flowing therein). Further, if oil is being circulated throughout the cooling system, a potentially insufficient amount of oil for lubrication the compressor may exist. As a result, increased amounts of friction and heat may result in operation of the compressor. Thus, separating the oil from the refrigerant or coolant is beneficial in ensuring efficient operation of the cooling system.

SUMMARY

One embodiment relates to an oil separator. The oil separator includes a housing having a nozzle and defining an internal space and an oil outlet; a body disposed within the internal space, the body including a mixed fluid inlet configured to receive a coolant and oil mixture and a nozzle that receives at least a portion of the coolant and oil mixture from the mixed fluid inlet and discharges coolant and oil into the internal space of the housing; and a wall disposed proximate to the nozzle of the body, wherein at least a portion of the discharged coolant and oil impacts the wall to direct the at least the portion of coolant and oil towards the nozzle of the housing. According to one configuration, a directional flow of coolant and oil in the body towards the nozzle of the body is substantially opposite to a main directional flow of coolant and oil towards the nozzle of the housing.

Another embodiment relates to a cooling system. The cooling system includes a compressor; and, an oil separator coupled to the compressor, the oil separator positioned downstream of the compressor and configured to receive a mixed fluid output from the compressor. The oil separator includes a housing defining an oil outlet and a coolant outlet; a body disposed within the housing, wherein the body includes: a mixed fluid inlet that receives the mixed fluid output from the compressor; and a conduit coupled to the mixed fluid inlet, wherein the conduit changes a flow direction of the mixed fluid output and directs the mixed fluid output to a separating device disposed within the body, and wherein the conduit defines at least one opening that directs collected oil to the oil outlet of the housing. In operation, coolant discharged from the body is directed to the coolant outlet of housing.

Still another embodiment relates to a method of operating an oil separator in a cooling system. The method includes receiving, by a body of the oil separator, an amount of a mixed fluid from a compressor, the mixed fluid including coolant and oil; imparting, by the body, a centrifugal flow to the at least a portion of the amount of mixed fluid; directing, by the body, separated oil caused from the centrifugal flow to openings defined by the body to guide the separated oil to an oil outlet of the oil separator; separating, by a separating device disposed within the body, oil from coolant; discharging, by a nozzle of the body, at least a portion of the separated oil and coolant into a housing of the oil separator, wherein the body is disposed within the housing; and directing, by the housing, the discharged coolant to a coolant outlet of the housing. a

DETAILED DESCRIPTION

Figure 1:
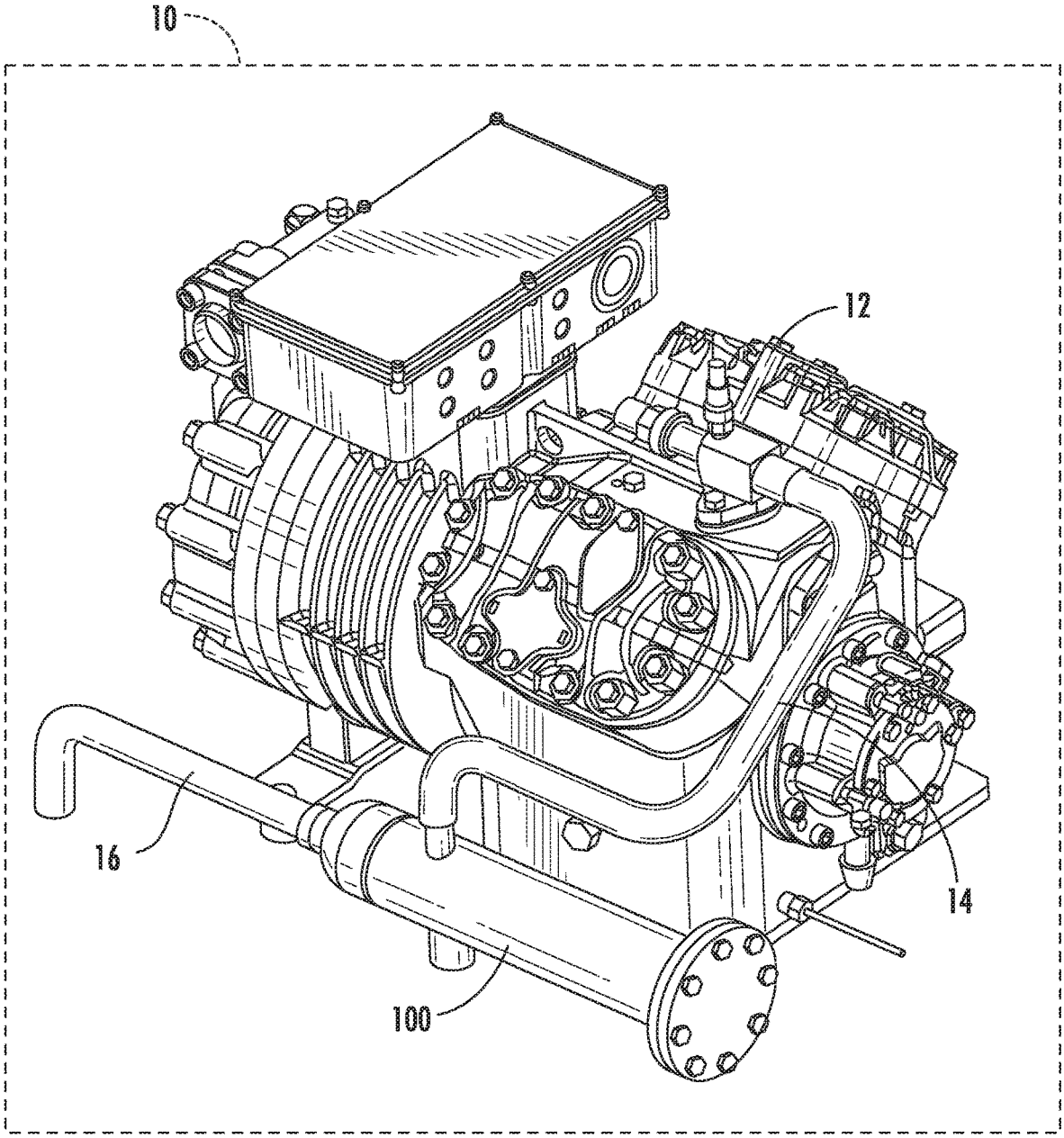
FIG. 1 is a perspective view of a part of a cooling system with an oil separator for a temperature controlled case, according to an exemplary embodiment.
Figure 2:
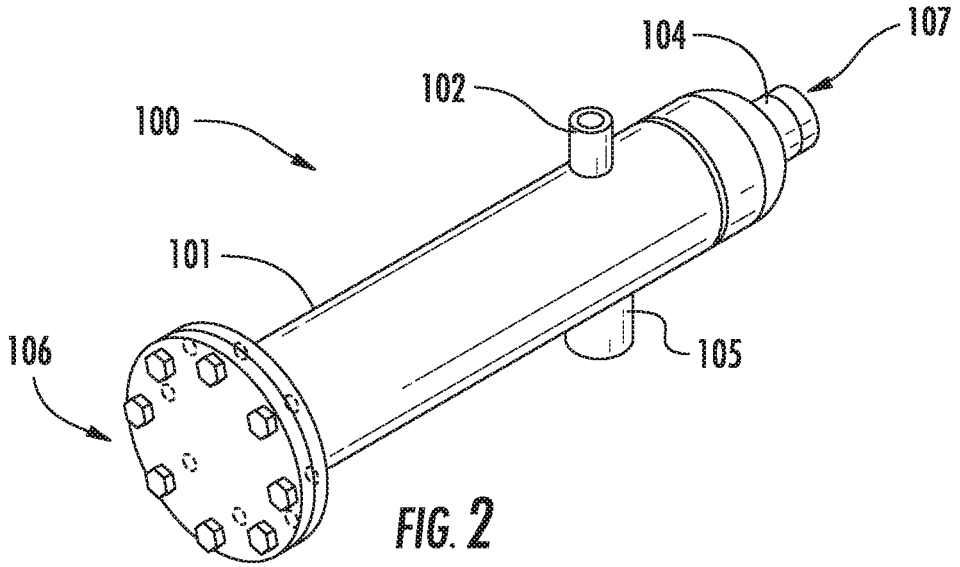
FIG. 2 is a perspective view of the oil separator of FIG. 1, according to an exemplary embodiment.

In the following detailed description, reference is made to the accompanying drawings, which form a part thereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

Referring to the Figures generally, various embodiments disclosed herein relate to a multistage oil separator for a temperature controlled case. According to the present disclosure, the multistage oil separator includes a plurality of stages for separating coolant from oil discharged from one or more compressors in a cooling system. As shown and described herein, the multistage oil separator is packaged in a compact unit that saves space and is easily implemented within existing cooling systems. According to the present disclosure, the multistage oil separator includes a housing having a nozzle, and defining an internal space with an oil outlet. The multistage oil separator further includes a body disposed within the internal space, and having a mixed fluid inlet, a conduit, and a nozzle. The mixed fluid inlet receives a coolant and oil mixture from the one or more compressors, changes a direction and velocity of the mixture via the conduit, and discharges the non-separated oil and coolant through the nozzle to the internal space. A wall provided in the internal space directs the discharged non-separated oil and coolant back towards an outlet of the housing and through a filtering element disposed within the internal space of the housing (e.g., a demister pad, a coalescing element, etc.). The filtering element functions to separate the oil from the coolant. During these operations, separated oil is channeled through one or more openings defined in the body to an oil outlet of the housing to, in turn, channel the oil back to the one or more compressors. Concurrently, separated coolant is channeled or guided to an outlet of the housing to guide, direct, or otherwise channel the separated cooling back to the cooling system for use. Beneficially, the multistage oil separator includes multiple stages that function to change a velocity and a direction in addition to providing separating or filtering of the coolant and oil to ensure that a majority of the discharged oil and coolant mixture from the one or more compressors is separated into the individual constituents and then provided back to the desired locations (e.g., the one or more compressors and the refrigeration or cooling system). These and other features and benefits are described more fully herein.

It should be understood that the terms "refrigerant" and "coolant" are used interchangeably herein. In this regard, Applicant contemplates that a wide variety of coolant or refrigerant types may be used with the multistage oil separator of the present disclosure. Further, while the multistage oil separator is described primarily herein with respect to a cooling system for a temperature controlled case, this explanation is not meant to be limiting as the multistage oil separator may be utilized in other and different environments as well.

Referring now to FIG. 1, a perspective view of a part 10 of a cooling system with an oil separator 100 for a temperature controlled case or cases (not shown) is depicted according to an exemplary embodiment. While not shown, the temperature controlled case or cases may have a variety of configurations from a vertically-oriented structure to a semi-vertically oriented structure to a horizontal-oriented temperature controlled case. The temperature controlled display device, also referred to herein as a temperature controlled case, may be a refrigerator, a freezer, a refrigerated merchandiser, a refrigerated display case, or other device capable of use in a commercial, institutional, industrial, or a residential setting for storing and/or displaying refrigerated or frozen objects. For example, the temperature controlled display device may be a service type refrigerated display case for displaying fresh food products (e.g., meat, dairy, produce, etc.) in a supermarket or other commercial setting. Example configurations of a temperature controlled case can be found in U.S. patent application Ser. No. 14/318,349, which is incorporated herein by reference in its entirety.

The cooling system is in thermal communication with a temperature controlled space of the temperature controlled case, such that the cooling system controls or manages the temperature of the temperature controlled space. The cooling system includes at least one cooling element (e.g. evaporator, cooling coil, fan-coil, evaporator coil, heat exchanger, etc.) and a unit. According to one embodiment, the unit is structured as a condensing unit or parallel condensing system when the cooling system is structured as a direct heat exchange system. The condensing unit may include any typical component included with condensing units in direct heat exchange systems, such as a compressor, condenser, receiver, etc. According to another embodiment, the unit is structured as a chiller (e.g., heat exchanger, etc.) when the cooling system is structured as a secondary coolant system. The chiller facilitates heat exchange between a primary refrigerant loop and a secondary coolant loop. The secondary coolant loop includes the cooling element and any other component typically included in the secondary coolant loops of secondary coolant systems. The primary refrigerant loop includes any typical components used in primary refrigerant loops of secondary coolant systems, such as a condenser, compressor, receiver, etc. In either configuration, during a cooling mode of operation, the cooling element may operate at a temperature lower than the temperature of the air within the temperature controlled space to provide cooling to the temperature controlled space. For instance and in regard to a direct heat exchange system, during the cooling mode, the cooling element may receive a liquid coolant from a condensing unit. The liquid coolant may lower the temperature of the cooling element below the temperature of the air surrounding the cooling element causing the cooling element (e.g., the liquid coolant within cooling element) to absorb heat from the surrounding air. As the heat is removed from the surrounding air, the surrounding air is chilled. The chilled air may then be directed to the temperature controlled space by at least one air mover or another air handling device in order to lower or otherwise control the temperature of the temperature controlled space.

With the above in mind, a part or portion 10 of a cooling system for a temperature controlled case is shown in FIG. 1. The portion 10 may be used in either of a direct exchange or a secondary coolant system. In the example shown, the portion 10 is part of a direct exchange cooling system.

As shown, the portion 10 of the cooling system includes a compressor 12 fluidly coupled via a pipe 14 (e.g., tube, conduit, channel, etc.) to an oil separator 100. In operation, the compressor 12 receives a refrigerant or a coolant from an evaporator or cooling element (not shown) in a saturated vapor form, and compresses the saturated vapor coolant to a high pressure vapor. The high pressure vapor coolant is discharged via the compressor discharge pipe 14 to the oil separator 100. As described herein, the oil separator 100 separates or substantially separates the oil from the coolant, such that the coolant is provided via the coolant output pipe 16 (e.g., tube, conduit, etc.) to a discharge header for a condensing unit/condenser in the cooling system, while the oil is channeled back to a desired location, such as a crankcase for the compressor 12 or an oil reservoir.

Before turning to the oil separator 100, it should be understood that the compressor 12 may have any type of typical configuration for use in a refrigeration or cooling system. For example, the compressor 12 may have any one of a variety of different compressor configurations: positive displacement compressors (e.g., rotary screw, rotary vane, rolling piston, reciprocating, etc.) to dynamic compressors (e.g., a centrifugal compressor). In each of these configurations, oil or another type of lubricant is used to lubricate the moving parts of the compressor 12 (e.g., the pistons, connecting rods, etc.). The oil may be stored in a crankcase. In operation, the oil may inadvertently seep into the compression cylinder(s) of the compressor 12. Because the oil and the coolant that is received by the compressor 12 are miscible, the result is a compressed coolant and oil mixture that is then received by the oil separator 100, which is structured to separate or mostly separate the coolant from the oil.

Referring now to FIGS. 2-6, views of the oil separator 100 are shown according to various exemplary embodiments. As described herein, the oil separator 100 is a multistage oil separator that utilizes multiple separation stages to separate the oil from the coolant to provide a relatively more effective oil separator than conventional oil separators. Generally speaking, the oil separator 100 includes a housing 101 (e.g., outer chamber) that defines an opening for receiving a mixed fluid input 102 of a body 108 disposed within the housing 101, an internal receiving volume 103, a coolant discharge outlet 104 that provides the separated coolant to the coolant output pipe 16, and an oil discharge outlet 105 that provides the separated oil to a desired location (e.g., a reservoir, a crank case, etc.). As mentioned above, a body 108 is disposed within the housing 101. As described in more detail below, the mixed fluid input 102 couples to the compressor discharge pipe 14 and to the body 108, such that the mixed fluid output from a compressor(s) is received firstly in the body 108 and, eventually, by the housing 101. In the example depicted, the oil discharge outlet 105 is positioned vertically opposite to that of the mixed fluid input 102. Further, each of the mixed fluid input 102 and the oil discharge outlet 105 are generally cylindrical in shape. In other embodiments, the size, relative sizes, shape, and placement may differ from that depicted in the FIGURES.

The housing 101 is generally an elongated tubular structure for housing, holding, and maintaining the components and separation stages of the oil separator 100. As shown, the housing 101 is generally cylindrical in shape stretching from a rear end 106 to a front end 107 proximate the coolant discharge outlet 104. In other embodiments, a variety of other shapes may be implemented with the housing 101 including, but not limited, prism-shaped, cube-shaped, etc. The housing 101 may be constructed from any suitable material or materials including, but not limited, metal and metal alloys (e.g., brass, aluminum, etc.).

A body 108 (e.g., internal chamber, inner housing, etc.) is disposed within the internal space of the housing 101. As mentioned above, the mixed fluid input 102 is directly coupled to the body 108, such that the fluid discharged from the compressor 12 is provided to the body 108 before being received by the internal volume 103 of the housing 101. In the example shown, the body 108 includes at least one stage of the multistage oil separator 100, which is described in more detail below. The body 108 generally defines a conduit 109 that receives mixed fluid from the mixed fluid input 102, a nozzle 110 that receives the mixed fluid from the conduit 109 and provides the mixed fluid to the internal volume 103 of the housing 101, and at least one opening 123 defined by the body 108 (particularly the conduit 109) proximate to the oil discharge outlet 105. As described herein, the at least one opening 123 is a channel or opening for collected oil to pass therethrough to the oil discharge outlet 105 of the housing 101. The exact number, placement, and size of the opening(s) 123 is highly configurable with all such variations intended to fall within the scope of the present disclosure.

The body 108 is supported and coupled to the housing 101 via a pair of support structures, shown as a first wall 111 proximate the nozzle 110 and a second wall 112 proximate the fluid inlet 102. The first and second walls 111 and 112 may be of integral construction with the body 108 (i.e., a one-piece component) or coupled to the body 108 via one or more components and fasteners or other adhesion processes (e.g., welding, etc.). The first and second walls 111 and 112 function to support the body 108 in the longitudinal center or at an approximate longitudinal center of the housing 101 (i.e., in the approximate middle of the inner walls of cylindrical portion of the housing 101). Due to this support structure, a top channel 113 is created between an upper external surface of the body 108 and a top inner wall of the housing 101 while a bottom channel 114 is created between a lower external surface of the body 108 and a lower inner wall of the housing 101. As described herein below, the top and bottom channel 113, 114 define additional fluid flow paths for at least a portion of the mixed fluid received by the oil separator. It should be understood that in operation, the top and bottom channels 113, 114 are connected to each other to form one continuous volume/channel. In this regard, this volume surrounds, at least mostly, the body 108 (in essence, a donut shape where the hole in the "donut" represents the body 108). The use of the channels 113 and 114 is used herein to ease explanation of operation of the oil separator 100.

As shown, the body 108 is generally cylindrical in shape. In particular, the body 108 has a matching or substantially matching shape to that of the housing 101. However, the orientation of the body 108 within the housing 101 is opposite to that of the housing 101. In this regard, the nozzle portion 110 is proximate the rear end 106 of the housing 101 while the rear end of the body 108 (near the wall 112) is proximate the coolant discharge outlet 104. As a result and in operation, a main fluid flow direction of the fluid in the body 108 is substantially opposite to the main flow direction of the fluid in the housing 101. In particular, the fluid in the body 108 moves towards the nozzle 110 while the fluid in the housing 101 moves towards the nozzle 115. Among other features described herein, this change of direction helps to separate the heavier weight molecules of the oil from the lighter weight molecules of the vapor coolant. As shown, the output of the nozzle 110 from the body 108 is longitudinally opposite to the coolant discharge output 104. Further and as shown, the mixed fluid input 102 is disposed closer to the coolant discharge output 104 than to a longitudinal center of the housing 101. As a result, a relatively longer flow path for the fluid flowing within the oil separator 100 is created. Beneficially, this orientation ensures multiple change of directions (and speeds) of the mixed fluid before reaching the nozzle 115 and outlet 107.

As alluded to above and in the example depicted, body 108 has the same general shape as the housing 101 except for the body 108 being of a relatively smaller scale (i.e., smaller length, width, etc.). Such a configuration may be beneficial from a manufacturing perspective where the components used to construct each of the housing 101 and the body 108 are substantially same except for being of different dimensions. Of course, in other embodiments, the body 108 may have a different shape relative to the housing (e.g., square shaped, etc.). All such variations are intended to fall within the scope of the present disclosure.

In the example depicted, the body 108 houses or holds a separation device 116 proximate to the nozzle 110; more particularly, the separation device 116 is positioned immediately upstream of the nozzle 110 of the body 108. In the example shown, the separation device 116 is configured as a demister and, more particularly, as a mesh-type structure demister. The demister (i.e., demister pad, wire mesh, etc.) is structured to obstruct the flow of the mixed fluid within the body 108 to the nozzle portion 110 and, more particularly, to filter or separate the liquid particles from the gaseous particles within the mixed fluid stream. In operation, the mixed fluid includes vapor coolant and liquid oil. The mesh structure of the demister traps the liquid particles of the oil while permitting the vapor coolant to pass or substantially pass there-through to the nozzle 110. Using gravity, the liquid oil is collected near a bottom of the body 108 (i.e., closer to the bottom space 114). Eventually and as described herein, the collected liquid oil is directed, channeled, or otherwise guided to the oil discharge outlet 105. The demister may have a variety of shapes, sizes, and structures (e.g., stainless steel wire mesh, etc.). In another embodiment, the separation device 116 is structured as a coalescer or coalescing element. In one embodiment, the coalescer or coalescent filter is constructed, at least partly, from a borosilicate/glass micro-fiber whereby the construction configuration includes multiple layers (e.g., a sandwich type filter). It should be understood that the coalescer is not limited to these materials or this structural configuration as the present disclosure contemplates more and other materials and construction configurations being applicable with the coalesce of the present disclosure. The coalescer includes a filter that causes the liquid oil particles to collide and "coalesce" into larger particles to thereby separate the liquid oil from the coolant vapor. The liquid oil is then eventually provided to the oil discharge outlet 105. In still another embodiment, the separation device 116 includes each of a demister and a coalescer. According to an alternate embodiment, the separation device 116 is excluded from the oil separator 100.

The nozzle 110 is positioned at or near a longitudinal end of the body 108 and, in particular, furthest from the inlet 102. The nozzle 110 receives the fluid from the separation device 116, accelerates the received fluid, and provides or discharges the fluid towards the rear end 106 of the housing 101. The size and structure of the nozzle 110 is highly variable. That said, the unifying feature is that the nozzle 110 is structured to increase the velocity of fluid. In the example shown, the nozzle 110 has the same or substantially the same characteristics (e.g., cross-sectional size reduction, etc.) as the nozzle 115, except that the nozzle 115 is of a larger scale than the nozzle 110. In other embodiments, the characteristics of the nozzle 115 may differ from that of the nozzle 110.

The housing 101 defines a receptacle 117 for receiving the discharge of the nozzle 110 of the body 108. The receptacle 117 is a part of the volume in the internal volume 103 of the housing 101. The receptacle 117 is disposed between the nozzle 110 and an interior wall 118 of the housing 101. It should be understood that the exact size of the receptacle 117 is highly variable: larger or small from that depicted in the FIGURES.

The wall 118 is proximate the rear end 106 of the housing 101 (i.e., proximate the nozzle 110 of the body 108). In the example shown, the wall 118 is a separate component relative to the remainder of the housing 101. In another embodiment, the wall 118 may be of integral construction with the housing 101. The wall 118 functions to seal or close off the rear part of the housing 101. As shown, the portion of the wall 118 facing the nozzle 110 or body 108 has a non-planar shape. In particular, the wall 118 is curved with a concave-shape relative to nozzle 110 of the body 108. As described herein, the curve shaped wall 118 receives the fluid discharged from the nozzle 110 to direct the fluid to each of the top and bottom channels 113 and 114. According to other embodiments, the wall 118 may have a different shape than that depicted in FIGURES (e.g., be planar, have a greater curvature than depicted, etc.).

Turning now to the support structures for the body 108, the wall 111 is proximate the receptacle 117 while the wall 112 is proximate the nozzle 115 of the housing 101. The wall 111 defines a plurality of openings 119 (e.g., holes, passages, voids, etc.). The openings 119 are disposed circumferentially on the wall 111, such that the openings 119 are created between the inner wall of the housing 101 and the wall 111. Likewise, the wall 112 defines a plurality of openings 120 (e.g., holes, passages, voids, etc.). The openings 120 are disposed circumferentially on the wall 112, such that the openings 120 are created between the inner wall of the housing 101 and the wall 112.

The openings 119 receive the fluid directed from the wall 118 into each of the top and bottom channels 113, 114. If the openings 119 were not present, the fluid would be trapped within the receptacle 117. Likewise, the openings 120 enable the fluid from the top channel 113 to be directed to the nozzle 115.

As shown, the wall 112 defines openings 120 only partially circumferentially about the wall 112. In this regard, the wall 112 is a solid structure between the lower part of the body 108 and the inner lower wall of the housing 101. This portion is circled as reference number 121 in FIG. 6. This solid structure and substantially impermeable portion 121 of the wall 112 functions to block or substantially block fluid flow from the bottom channel 114 to the nozzle 115. Rather, the fluid in the bottom channel 114 may impact the wall 112 (particularly, the bottom part 121), which directs the fluid toward the oil discharge outlet 105. Because oil is relatively heavier than the vapor coolant, at least some of the oil in the fluid that impacts the wall and due to gravity is directed to the oil discharge outlet 105. In contrast, the vapor coolant that impacts the bottom portion 121 of the wall 112 may rise up towards the outlets 120 to be received, eventually, by the nozzle 115. Beneficially, such a structure (in addition to the other separation stages) may ensure or substantially ensure that substantially only vapor coolant is discharged via the outlet 107 of the housing 101.

Figure 3:
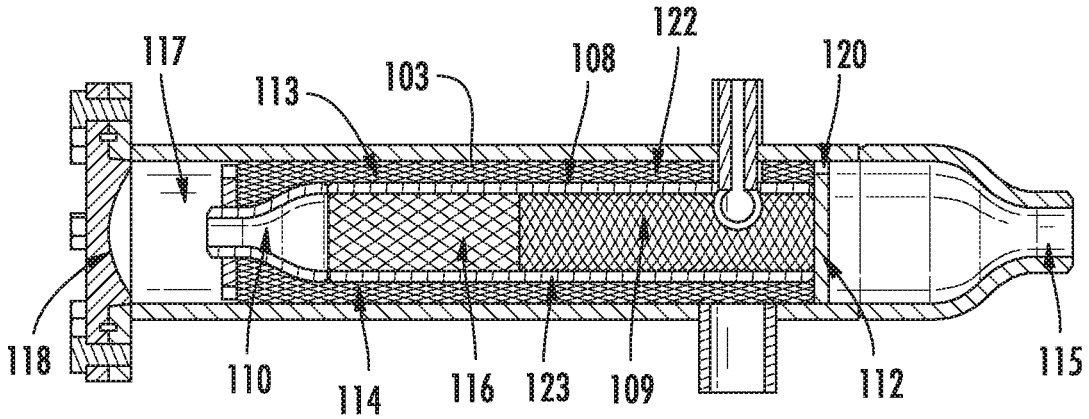
FIG. 3 is a side longitudinal cross-sectional view of the oil separator of FIGS. 1-2, according to an exemplary embodiment.
Figure 4:
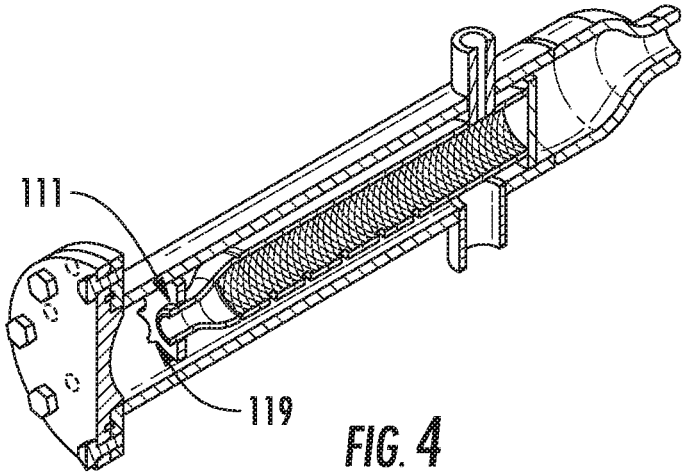
FIG. 4 is a perspective longitudinal cross-sectional view of the oil separator of FIGS. 1-2, according to an exemplary embodiment.
Figure 5:
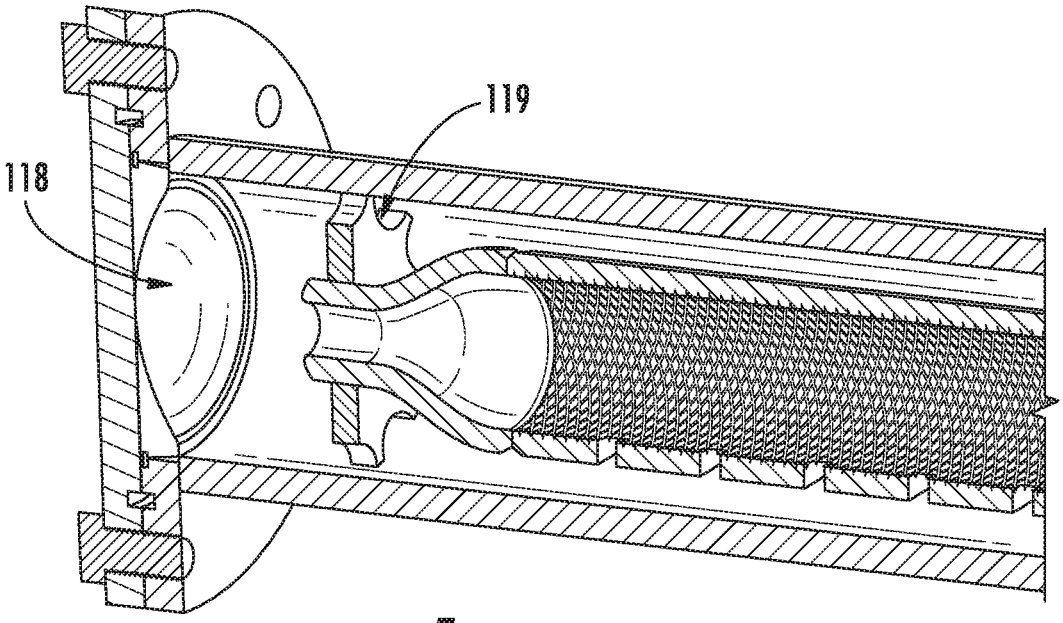
FIG. 5 is a close-up perspective longitudinal cross-sectional view of the oil separator of FIGS. 1-2 proximate a rear wall of the oil separator, according to an exemplary embodiment.
Figure 6:
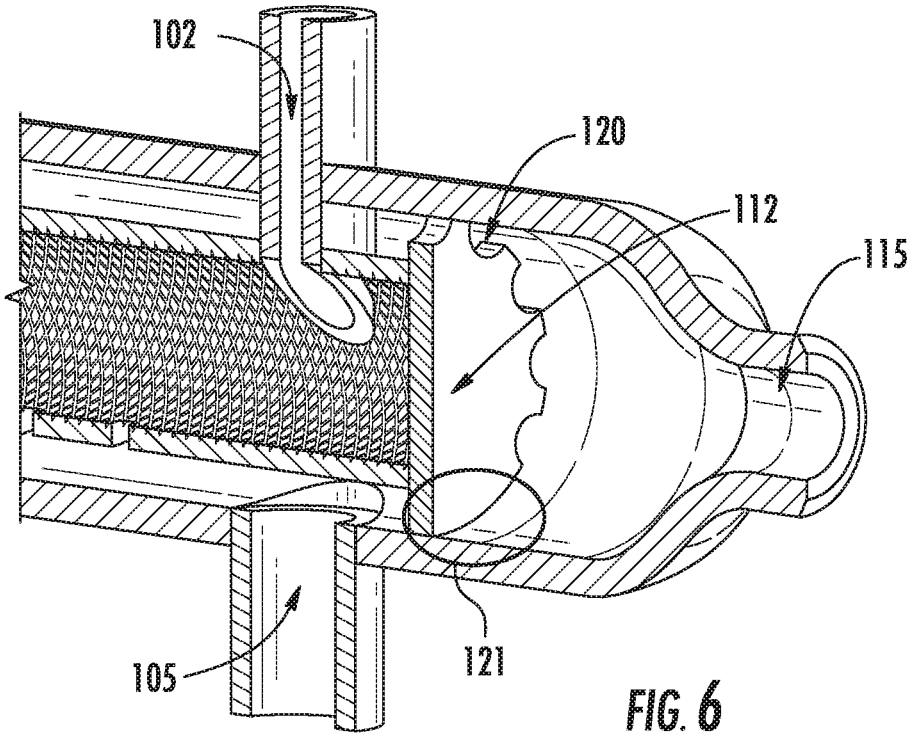
FIG. 6 is a close-up perspective longitudinal cross-sectional view of the oil separator of FIGS. 1-2 proximate a refrigerant outlet of the oil separator, according to an exemplary embodiment.

As shown in FIG. 3 and in this example configuration, a filtering element 122 is disposed within the top and bottom channels 113, 114. The filtering element 122 is structured to filter or otherwise further separate oil from the coolant that is directed from the wall 118 to the channels 113, 114 towards the nozzle 115 and coolant outlet 104 of the housing 101. As shown, the filtering element 122 is disposed between the walls 111 and 112 and surrounds, or substantially surrounds, the body 108. In this regard, the filtering element 122 extends substantially the longitudinal length of the distance between the walls 111 and 112. Thus, fluid directed via the openings 119 of the wall 111 encounters the filter element 122. In the example shown, the filtering element 122 is a demister or demister pad, which may have the same or similar structure as described above with respect to the separation device 116. In another embodiment, the filter element 122 may be a coalescer or coalescing element. In an alternate embodiment, the filtering element 122 is excluded from the oil separator 100.

Figure 7:
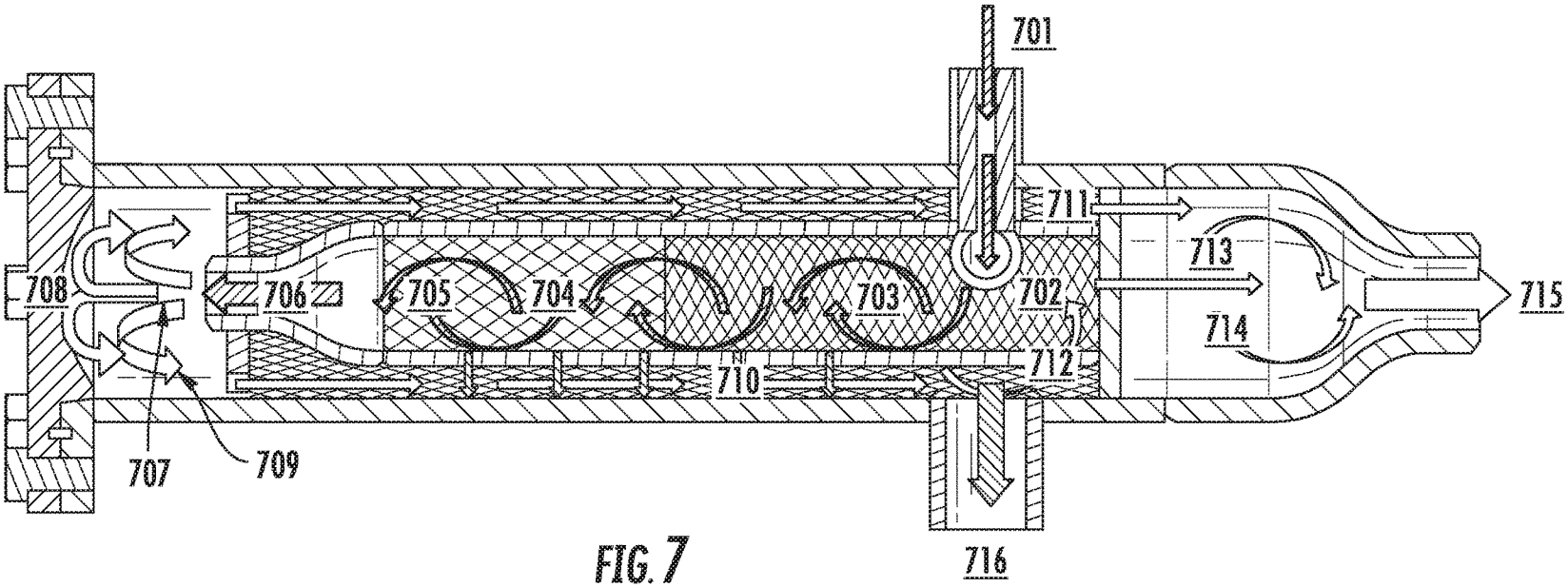
FIG. 7 is a side longitudinal cross-sectional view of the oil separator of FIGS. 1-2 with annotations that show a method of operating the oil separator of FIGS. 1-2, according to an exemplary embodiment.

With the above structure of the oil separator 100 in mind, a method of operating the oil 100 separator 100 is shown in FIG. 7, according to an exemplary embodiment. Additional details regarding the structure of the oil separator 100 are also provided with reference to FIG. 7.

At process 701, high velocity gas/oil mixture (the "mixed fluid") is received via the mixed fluid inlet 102 from the compressor 12 and compressor discharge pipe 14. As mentioned above, this gas (i.e., vapor refrigerant) and oil mixture results from the oil used to lubricate the compressor 12 seeping into the compression cylinder(s) where it mixes with the refrigerant that is compressed by the compressor 12. It should be understood that the particular types of oil and refrigerant are highly configurable based upon a variety of circumstances: for example, the oil required by the manufacturer of the compressor; alternatives to this prescribed oil; the cooling load required from the cooling system, which may impact the refrigerant chosen; etc. Those of ordinary skill in the art will readily recognize and appreciate the high configurability of the oil and refrigerant.

At process 702, the mixed fluid is received by the body 108 from the mixed fluid inlet 102. At which point, the mixed fluid impacts a lower internal wall of the body 108, which causes the mixed fluid to change direction and experience a velocity drop. At this point, the oil separator 100 is beginning to separate the liquid oil from the vapor refrigerant while the mixed fluid is within the conduit 109.

At process 703, the vapor refrigerant and liquid oil mixture is directed or imparted into a centrifugal and reverse helical flow pattern within the body 108. This is caused, at least in part, from impacting the lower internal wall of the body 108 in the conduit 109. Liquid oil has heavier particles than the vapor refrigerant. The centrifugal and reverse helical flow pattern causes a reduction in velocity of the vapor refrigerant and the liquid oil mixture. In operation, the centrifugal action causes the heavier oil particles to move outward towards in the internal outer wall of the body 108. The heavier oil particles then collect on the wall. Eventually and because the particles of liquid oil are heavier than that of the vapor refrigerant, the liquid oil is directed to the lower internal wall of the body 108 via gravity for discharging (i.e., proximate to the oil discharge pipe 105) while the refrigerant vapor moves towards the nozzle part 110. The openings 123 then enable the fallen liquid oil to travel towards the oil discharge outlet 105.

At process 704 and during the centrifugal and reverse helical flow pattern, vapor refrigerant and liquid oil mixture is separated through the separation device 116. While some of the liquid oil received via the inlet 102 is captured due to the velocity and direction changes from process 703, another part of the liquid oil is captured through interacting with the separation device 116. In particular, the heavier liquid oil particles contact the mesh structure of the demister thereby creating a lump or mass for more liquid oil particles to latch onto. Due to gravity, these masses of liquid oil then fall to the bottom of the body 108 and are eventually channeled to oil discharge outlet 105 (e.g., via the opening 123). Due to being less dense and lighter weight, the vapor refrigerant tends to pass through the demister towards the nozzle 110.

At process 705, the remaining liquid oil and vapor refrigerant fluid is accelerated having a turbulent flow via the nozzle portion 110 of the body. At process 706, the turbulent flow of the remaining liquid oil and vapor refrigerant is converted into a linear flow, a direction of the flow stays constant through the nozzle 110 to the receptacle 117, and the velocity of the flow increases. At least a portion of the previously separated oil and coolant is discharged via the nozzle 110 of the body 108 into the housing 101 (i.e., the internal volume 103).

The separating processes that occur within the body 108 may be referred to as "stage one" of the oil separator 100. To summarize, stage one includes the centrifugal and reverse helix flow patterns, the capturing of liquid oil particles via the demister pad, and the acceleration of the flow via the nozzle part 110. Collectively, these processes of stage one function to at least partly separate the liquid oil from the vapor refrigerant that is received by the body 108 via the mixed fluid inlet 102.

At process 707, liquid oil and vapor refrigerant that has been discharged via the nozzle 110 undergoes a hemispherical flow accompanied by a velocity decrease and a change in direction in the receptacle 117. At process 708, at least some of the liquid oil and vapor refrigerant that has been discharged via the nozzle 110 strikes or impacts the wall 118. As a result and due at least in part to the concavity of the wall 118, a hemispherical flow results, which is accompanied with a velocity decrease and a change in direction of the fluid flow.

Processes 707-708 may be referred to as "stage two" of the oil separator 100. As described above, stage two corresponds with a collision (the liquid oil and vapor refrigerant impacting the wall 118) and multiple changes of direction and velocity. The heavier liquid oil particles tend to stay along their flow path trajectory while the lighter vapor refrigerant particles tend to scatter due to the changes in speed and direction. As a result, additional separation between the liquid oil and the vapor refrigerant occurs in stage two. That said, the non-planar wall 118 helps or aids to direct the flow towards the channels 113, 114 and back towards the nozzle 115 of the housing 101.

At process 709, the remaining liquid oil and vapor refrigerant experiences an increase in velocity through the plurality of openings 119 of the wall 111. The impacting with the wall 111 and the throttling of the flow through the openings 119 results in a velocity increase, a change of direction, and a curvature flow. At process 710, at least some of the remaining liquid oil and vapor refrigerant that passes through the openings 119 is collected or filtered via the filtering element 122. As a result of the impact with the filtering element 122, velocity and the directional changes may occur with the remaining liquid oil and vapor refrigerant.

Processes 709-710 may be referred to as "stage three" of the oil separator 100. As described above, the channels 113, 114 actually surround or mostly surround the body 108. As a result, a large amount of surface area of the body 108 is exposed to liquid oil and refrigerant vapor passing through the openings 119 towards the nozzle 115 and coolant outlet 104. The heavier molecule liquid oil tends to latch onto these surfaces thereby further separating the liquid oil from the vapor refrigerant (in addition to the demisting accomplishing at least some separation of the liquid oil from the vapor refrigerant).

At process 711, additional non-collected liquid oil and vapor refrigerant undergoes a curvature flow, a direction change, and a velocity increase through the plurality of openings 120 in the wall 112 as towards the nozzle 115 of the housing 101. At process 712, the additional non-collected liquid oil and vapor refrigerant experiences a curvature flow, a directional change, and a velocity increase as this part of the flow from or near the bottom channel 114 moves towards the wall 112 and the nozzle 115 of the housing 101. At processes 713 and 714, the flows from processes 711 and 712 combine to form a turbulent flow with an associated velocity decrease and a direction change.

Processes 711-714 may be referred to as "stage four" of the oil separator 100. During this stage, the vapor refrigerant and liquid oil flows into and is assembled in the volume immediately upstream of the nozzle 115 of the housing 101. The assembly of flows results in changes of direction and velocity. However, at this stage, the flow is primarily vapor refrigerant and very little liquid oil. As a result, this is more of an assembly stage of the vapor refrigerant in the housing 101 for providing this collection of vapor refrigerant back to the other components of the cooling or refrigeration system.

At process 715, the combined flow, which is now predominately or mostly refrigerant vapor, goes through the nozzle 115 to be discharged from the oil separator 100 via the coolant outlet 104. The nozzle 115 functions to cause a linear flow with a velocity increase. The refrigerant may then be provided to the discharge pipe 16 and reused in the refrigeration system.

At process 716, the separated liquid oil from the various stages is collected and channeled through the oil discharge pipe 105. While process 716 is described in the last step, it should be understood that the accumulation and collection of liquid oil occurs concurrently with various processes. Beneficially, by channeling collected liquid oil back to the compressor as quickly as possible ensures or substantially ensures that the oil level is maintained or substantially maintained. The collected oil may be directed back to one or more desired locations: e.g., a crankcase for the compressor 12, one or more oil circulation channels of the compressor 12, a collection reservoir, etc.

Beneficially, the multiple stages of the oil separator 100 work to separate the liquid oil from the vapor refrigerant to ensure that substantially only the refrigerant is used in the refrigeration system while substantially only the liquid oil is used with only the compressor 12. Moreover, the combination of multiple different stages accounts for various shortcomings that may be present in each stage individually. For example, the centrifugal and reverse helix flow in stage one is most effective with the highest velocity of the flow, which is present from the inlet 102. While this stage may be positioned elsewhere in the oil separator 100, the efficiency would likely decrease compared to that which is presently experienced due to the change of velocity being smaller.

Referring now to FIGS. 8-13, implementation systems for the oil separator 100 are shown according various exemplary embodiments. Similar reference numbers are used throughout these Figures and herein to ease explanation thereof. It should be understood that the systems 800, 900, 1000, 1100, and 1200 represent a portion of a cooling system. Thus, these systems 800, 900, 1000, 1100, and 1200 show how the oil separator 100 may be implemented with various cool system configurations. Additionally, it should be understood that while each system implementation shows a certain number of compressors or oil separators, in other embodiments, the precise number may vary from that depicted in FIGS. 8-13.

Figure 8:
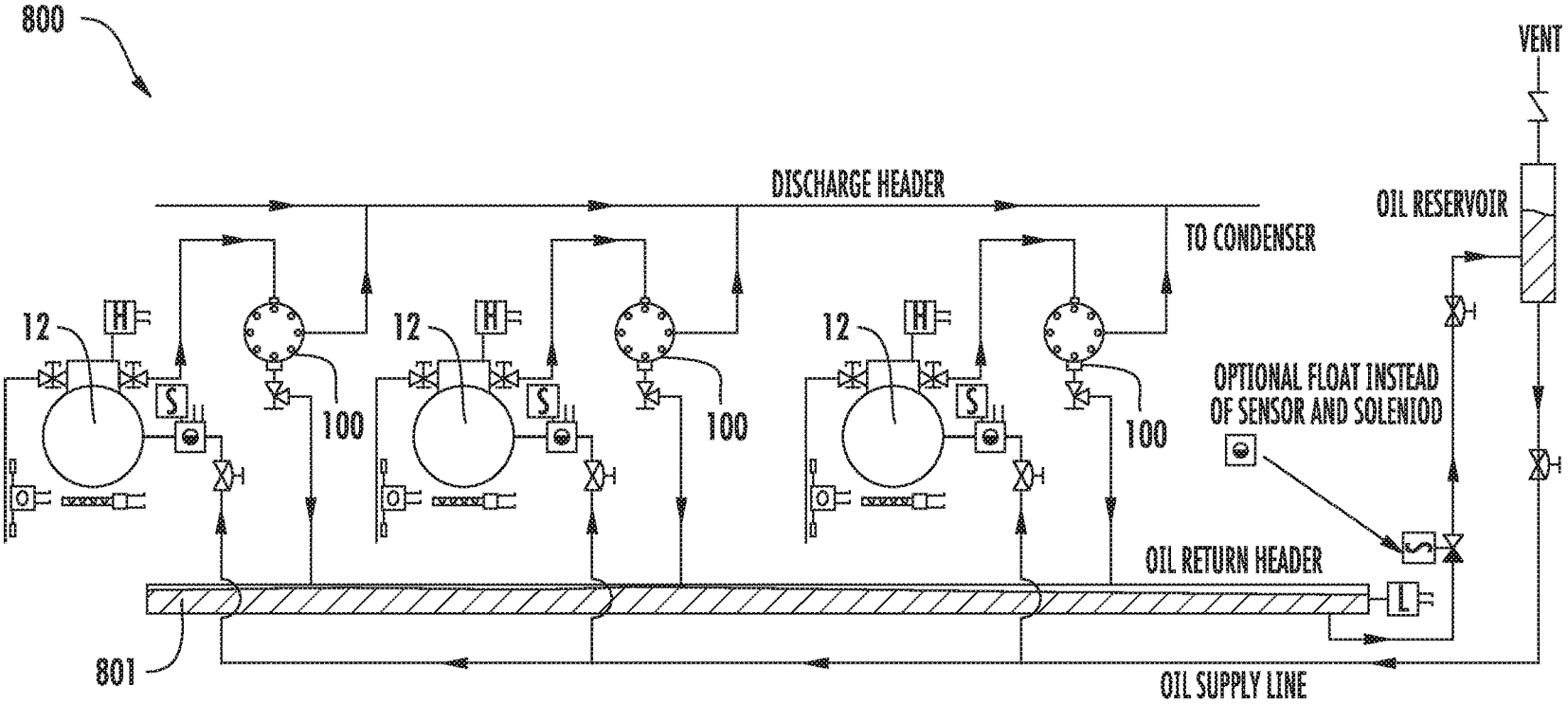
FIG. 8 is a schematic diagram of a part of a system that uses the oil separator of FIGS. 1-2, according to an exemplary embodiment.

Referring first to FIG. 8, a system 800 that utilizes multiple oil separators 100 with multiple compressors 12 is shown, according to an example embodiment. In this configuration, one oil separator 100 is used with one compressor 12. The refrigerant discharge outlet from each oil separator 100 is fed into a common line. Similarly, the oil discharge from each oil separator 100 is fed into a common line. The oil channeled to the common line may then return to each compressor 12 for use. System 800 depicts an oversize oil collection header 801, which collects the discharged oil from each oil separator 100. Eventually, oil collected in the oil discharge header 801 is circulated back to each of the compressors 12. As shown herein, other implementations may exclude the header 801 altogether.

Figure 9:
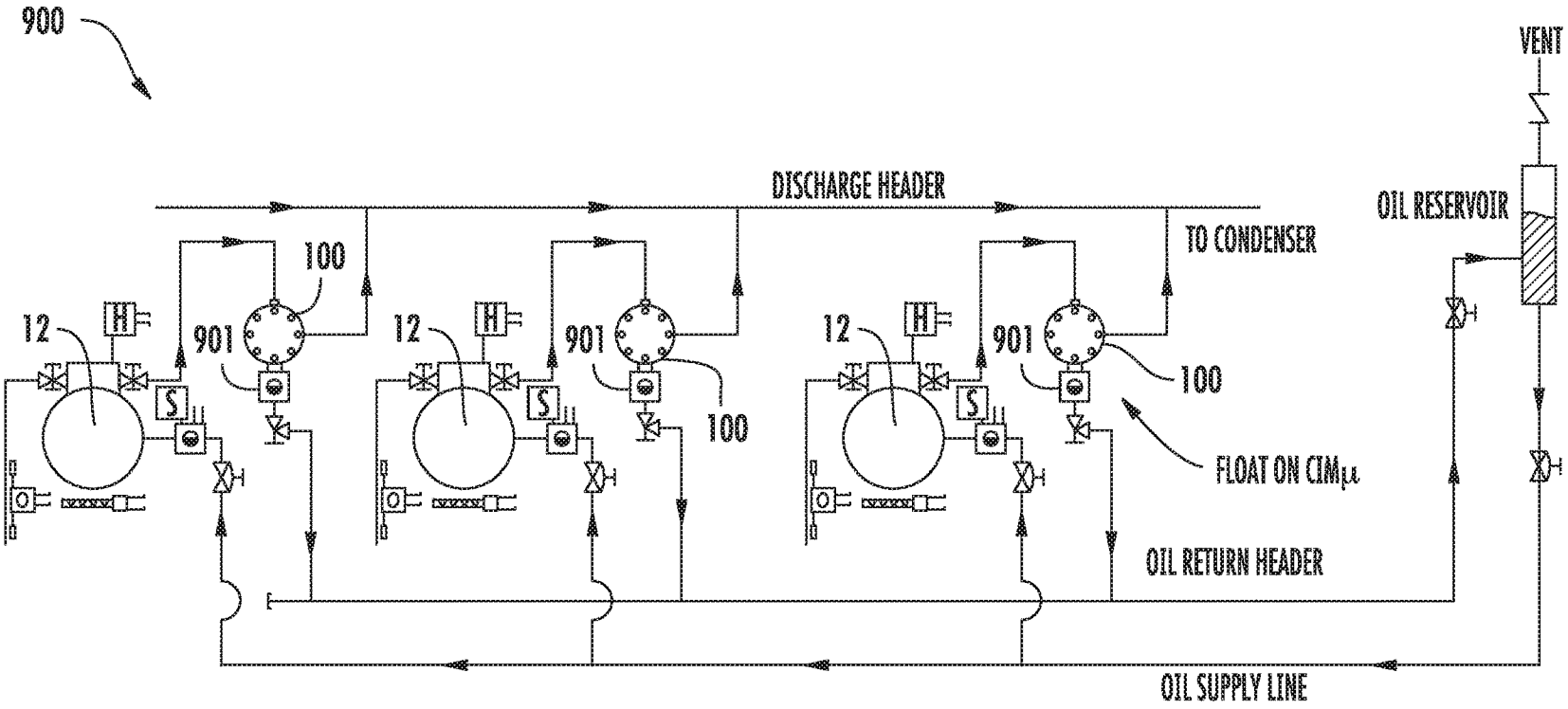
FIG. 9 is a schematic diagram of a part of a system that uses the oil separator of FIGS. 1-2, according to another exemplary embodiment.

Referring now to FIG. 9, a system 900 with an oil separator 100 having a float 901 is shown according to an exemplary embodiment. The system 900 is substantially the same as the system 800 except for the exclusion of the oversized header 801 and the inclusion of a float 901. As shown, one float 901 is used with each oil separator 100. The float 901 is used to selectively allow the collected oil to be channeled to a desired location, such as an oil reservoir and back to the compressor. In operation, as the level of oil rises above a certain threshold within the oil separator 100, the float 901 is actuated to open a valve to enable the collected oil to be guided or directed to the desired location. In the example shown, the float 901 is a mechanical float associated with a valve. In other embodiments, an electronic float may be used. The electronic float may be beneficial because it may allow for remote actuation.

Figure 10:
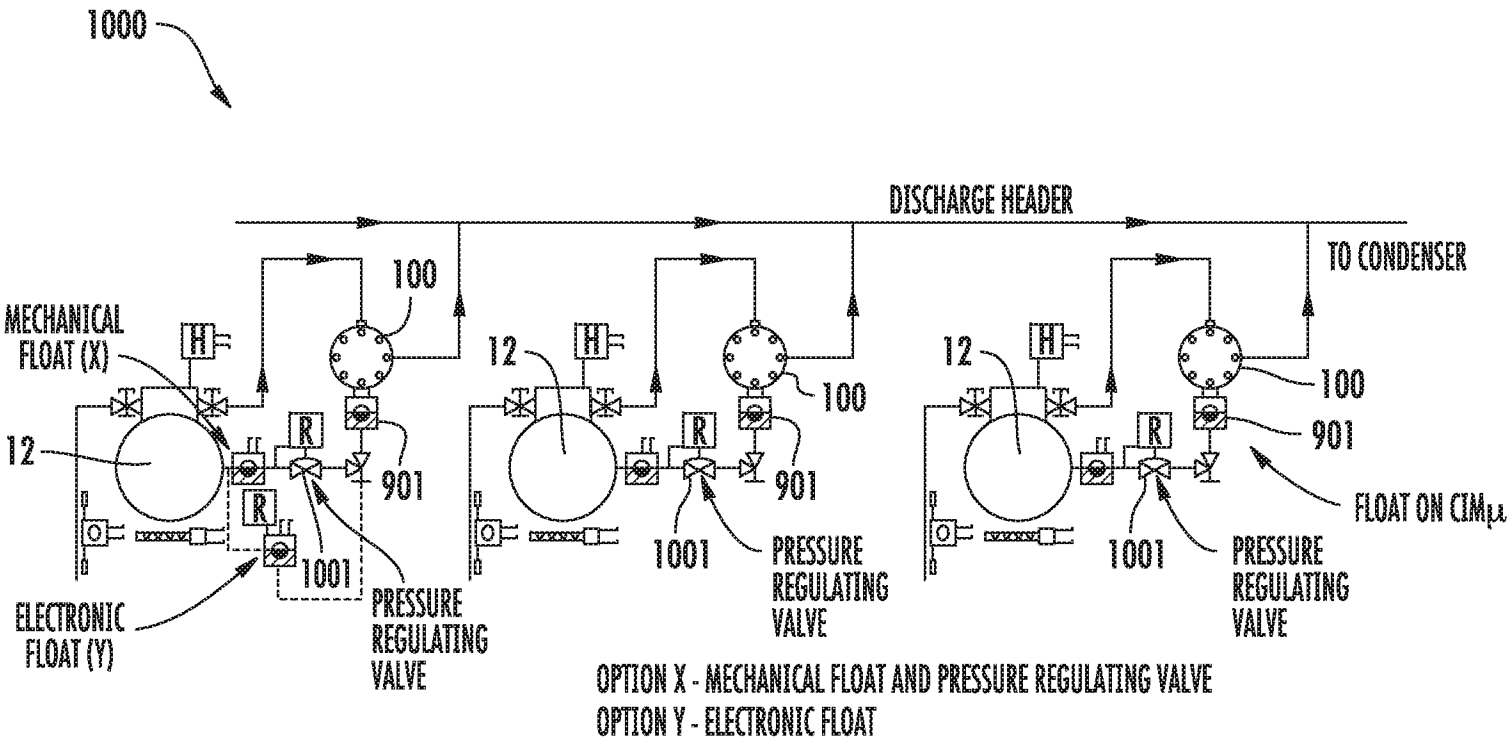
FIG. 10 is a schematic diagram of a part of a system that uses the oil separator of FIGS. 1-2, according to still another exemplary embodiment.
Figure 11:
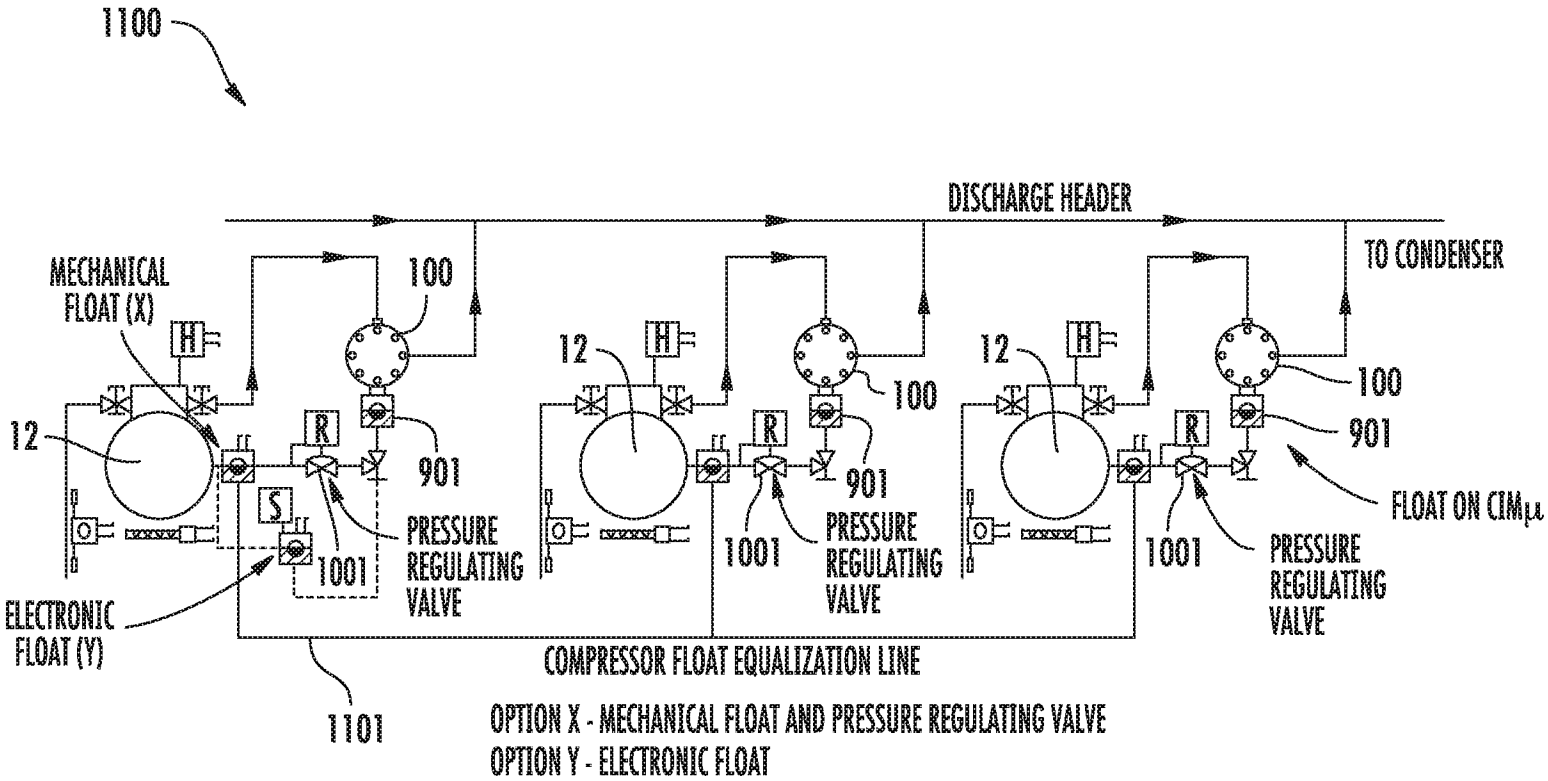
FIG. 11 is a schematic diagram of a part of a system that uses the oil separator of FIGS. 1-2, according to yet another exemplary embodiment.
Figure 12:
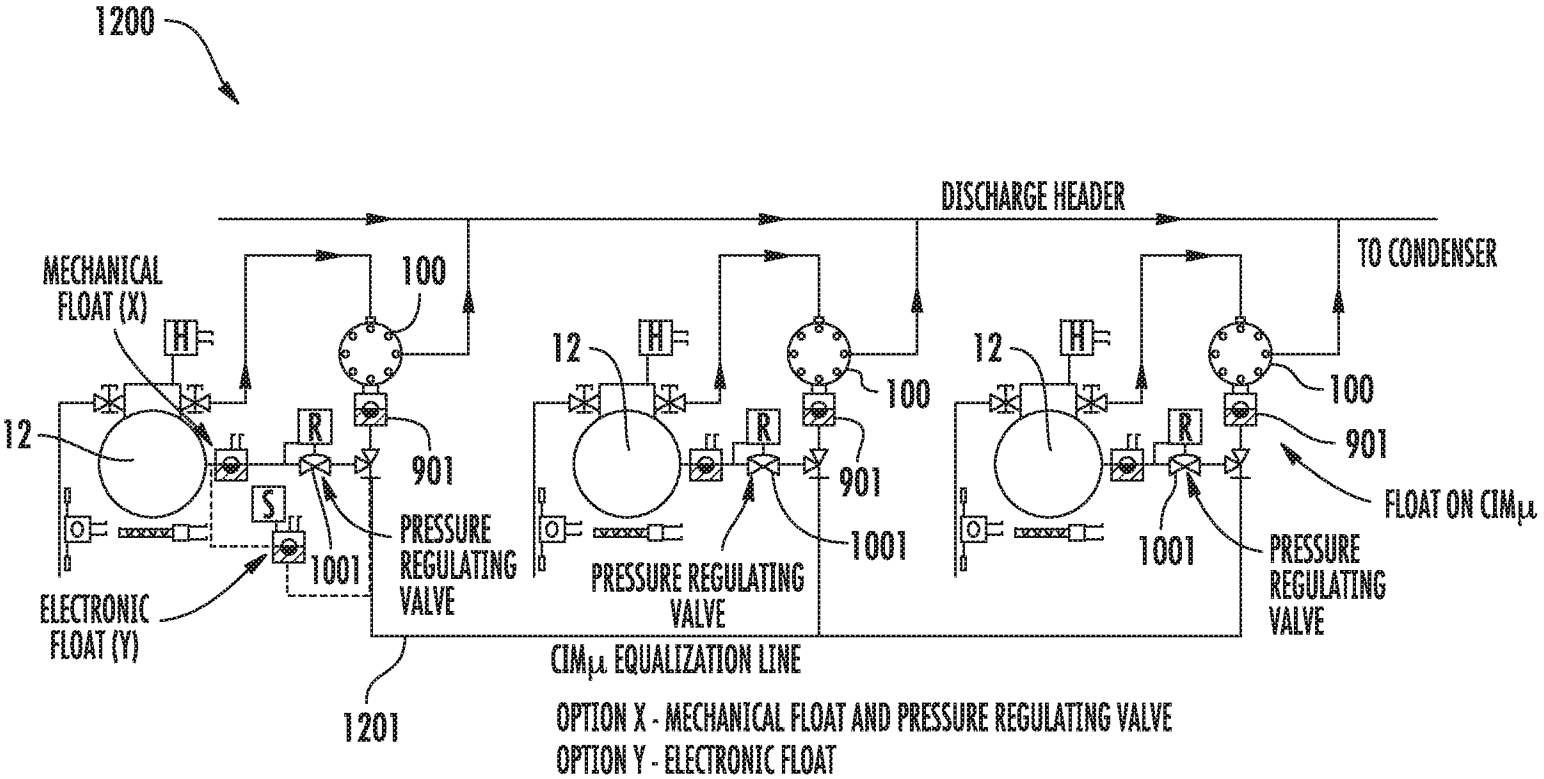
FIG. 12 is a schematic diagram of a part of a system that uses the oil separator of FIGS. 1-2, according to yet another exemplary embodiment.

Referring now to FIGS. 10-12, systems 1000-1200 are shown with pressure regulating valves and floats according to various exemplary embodiments. Relative to the system 900, in system 1000, a pressure regulating valve 1001 is provided with each of the separators 100. The pressure regulating valve 1001 regulates the pressure of the oil discharged from the oil separator 100 to the input of the compressor 12, such that the pressure of the oil provided to the compressor 12 is at or near a desired intake pressure. The pressure regulating valve 1001 may be beneficial to avoid high pressure oil spikes that may be provided to the compressor when the float 901 is used and no oil collection reservoir. In system 1100, a compressor float equalization line 1101 is implemented in order to maintain the intake oil pressure across each of the compressors 12 at or near the desired intake pressure. In system 1200, an oil separator equalization line 1201 is implemented in order to maintain the oil compressor float pressure 901 equal or substantially equal with each oil compressor 100. Beneficially, such an arrangement will ensure equalizing the output pressure from each of the oil separators 100 to avoid large discrepancy operating conditions from each oil separator 100.

Figure 13:
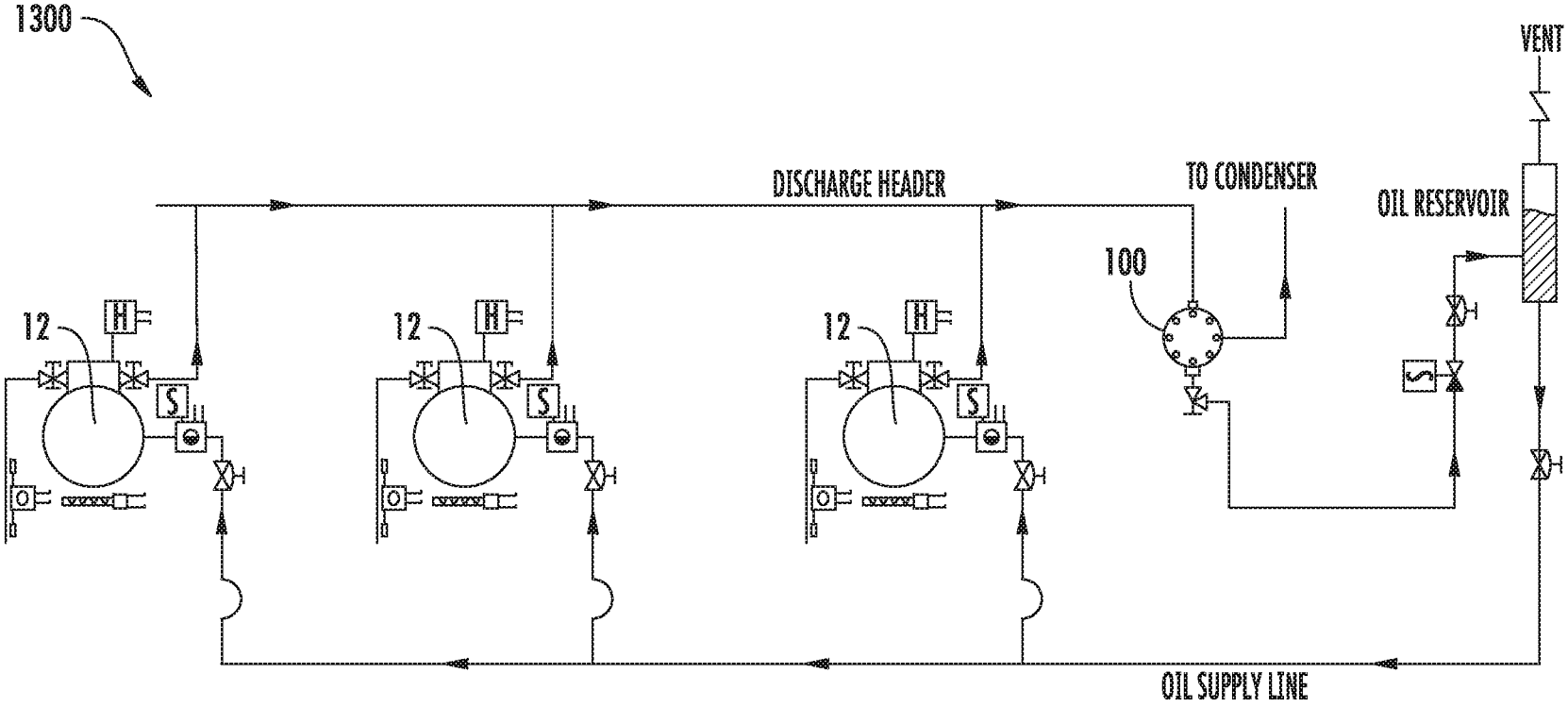
FIG. 13 is a schematic diagram of a part of a system that uses the oil separator of FIGS. 1-2, according to still a further exemplary embodiment.

Referring now to FIG. 13, a system 1300 with multiple compressors 12 coupled to a single oil compressor 100 is shown, according to an exemplary embodiment. In this configuration, the single oil separator 100 separates discharged oil and coolant from each of compressor 12. Such a configuration may be beneficial in a low cooling load operation where the output from each individual compressor is not very high. Another benefit of this configuration may be the occupied space or footprint is relatively lower when only one oil separator 100 is utilized. Still another benefit may be the reduction in cost that is achieved by only using one oil separator.

It should be understood that in each system 800-1300, only certain components are shown and described. It is to be understood that each system may include a variety of other components with various functionalities in a variety of different embodiments. For example, straining or filtering devices may be positioned downstream of the oil discharge outlet or the coolant outlet from the oil separator. These devices may filter out impurities from each of the outlets. As another example, various sensors may be utilized for various control and/or diagnostic purposes (e.g., pressure sensor, flow sensor, temperature sensor, etc.). Those of ordinary skill in the art will readily recognize and appreciate the high configurability of each of the systems 800-1300 without departing from the spirit and scope of the present disclosure.

It should be noted that references to "front," "rear," "upper," "top," "bottom," "base," and "lower" in this description are merely used to identify the various elements as they are oriented in the Figures. These terms are not meant to limit the element which they describe, as the various elements may be oriented differently in various embodiments.

Further, for purposes of this disclosure, the term "coupled" or other similar terms, such as "attached," means the joining of two members directly or indirectly to one another. Such joining may be stationary in nature or moveable in nature and/or such joining may allow for the flow of fluids, electricity, electrical signals, or other types of signals or communication between the two members. Such joining may be achieved directly with the two members or the two members and any additional intermediate members being attached to one another and the two members. For example and for the purposes of this disclosure, component A may be referred to as being "coupled" to component B even if component C is an intermediary, such that component A is not directly connected to component B. On the other hand and for the purposes of this disclosure, component A may be considered "coupled" to component B if component A is directly connected to component B (e.g., no intermediary). Such joining may be stationary or moveable in nature. Such joining may be permanent in nature or alternatively may be removable or releasable in nature.

It is important to note that the construction and arrangement of the elements of multistage oil separator provided herein are illustrative only. Although only a few exemplary embodiments of the present disclosure have been described in detail in this disclosure, those skilled in the art who review this disclosure will readily appreciate that many modifications are possible in these embodiments without materially departing from the novel teachings and advantages of the disclosure. Accordingly, all such modifications are intended to be within the scope of the disclosure.

The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating configuration and arrangement of the preferred and other exemplary embodiments without departing from the spirit of the present disclosure as expressed in the appended claims.

What is claimed:

1. An oil separator, comprising:

a housing having a first nozzle and defining an internal space and an oil outlet;

a body disposed within the internal space, the body including a mixed fluid inlet configured to receive a coolant and oil mixture and a second nozzle that receives at least a portion of the coolant and oil mixture from the mixed fluid inlet and discharges coolant and oil into the internal space of the housing; and a wall disposed proximate to the second nozzle, wherein at least a portion of the discharged coolant and oil impacts the wall to direct the at least the portion of coolant and oil towards the first nozzle;

wherein a directional flow of coolant and oil in the body towards the second nozzle is substantially opposite to a main directional flow of coolant and oil towards the first nozzle; and wherein the second nozzle is of a same or substantially same shape as the first nozzle except that the second nozzle is of a smaller scale than the first nozzle.

2. The oil separator of claim 1, wherein the wall has a non-planar shape to facilitate directing the at least the portion of coolant and oil towards the first nozzle.

3. The oil separator of claim 1, wherein the wall has a concave shape relative to a location of the second nozzle.

4. The oil separator of claim 1, wherein the body includes a separator disposed upstream of the second nozzle.

5. The oil separator of claim 4, wherein the separator is at least one of a demister pad and a coalescing element.

6. The oil separator of claim 1, further comprising a filtering element disposed substantially around the body within the internal space, wherein the filtering element includes at least one of a demister pad and a coalescing element.

7. A cooling system, comprising:

a compressor; and an oil separator coupled to the compressor, the oil separator positioned downstream of the compressor and configured to receive a mixed fluid output from the compressor, wherein the oil separator includes:

a housing defining an oil outlet and a coolant outlet;

a body disposed within the housing, wherein the body includes:

a mixed fluid inlet that receives the mixed fluid output from the compressor; and a conduit coupled to the mixed fluid inlet, wherein the conduit changes a flow direction of the mixed fluid output and directs the mixed fluid output to a separating device disposed within the body, and wherein the conduit defines at least one opening that directs collected oil to the oil outlet of the housing;

wherein coolant discharged from the body is directed to the coolant outlet of housing.

8. The cooling system of claim 7, wherein the separating device is at least one of a demister pad and a coalescing element.

9. The cooling system of claim 7, further comprising a wall coupled to the housing and configured to at least partially support the body within the housing, wherein the wall defines a plurality of openings.

10. The cooling system of claim 9, wherein the oil separator includes a wall positioned proximate to an outlet of the body, wherein the outlet provides a portion of oil and a portion of coolant from the mixed fluid outlet, wherein the wall directs the portions of oil and coolant through at least one opening in the plurality of openings towards the coolant outlet of the housing.

11. The cooling system of claim 10, further comprising a filtering element disposed at least partially around the body, wherein the filtering element receives the portions of oil and coolant that passes through the at least one opening in the plurality of openings.

12. The cooling system of claim 11, wherein the filtering element is at least one of a demister pad and a coalescing element.

13. The cooling system of claim 7, further comprising a wall coupled to the housing and configured to at least partially support the body within the housing, wherein the wall defines at least one opening configured to allow coolant within the housing to pass through to the coolant outlet of the housing.

14. The cooling system of claim 7, further comprising another compressor, wherein a mixed fluid outlet of the another compressor is provided to the oil separator.

15. The cooling system of claim 7, wherein the housing has a cylindrical external shape and the body has a cylindrical external shape such that the shape of each of the body and the housing substantially match each other.

16. A method of operating an oil separator in a cooling system, the method comprising:

receiving, by a body of the oil separator, an amount of a mixed fluid from a compressor, the mixed fluid including coolant and oil;

imparting, by the body, a centrifugal flow to the at least a portion of the amount of mixed fluid;

directing, by the body, separated oil caused from the centrifugal flow to openings defined by the body to guide the separated oil to an oil outlet of the oil separator;

separating, by a separator disposed within the body, oil from coolant;

discharging, by a nozzle, at least a portion of the separated oil and coolant into a housing of the oil separator, wherein the body is disposed within the housing;

directing, by the housing, the discharged coolant to a coolant outlet of the housing; and filtering, by a filtering element disposed within the housing, the discharged portion of separated oil and coolant from the body.

17. The method of claim 16, wherein the separator is at least one of a demister pad and a coalescing element.

18. The method of claim 16, further comprising directing, by the housing, the portion of separated oil and coolant in a direction towards the coolant outlet of the housing, wherein the direction is substantially opposite to the discharged direction of the portion of separated oil and coolant from the body.

* * * * *